US011591130B1

(12) United States Patent
Avila

(10) Patent No.: US 11,591,130 B1
(45) Date of Patent: Feb. 28, 2023

(54) STACKABLE AND FOLDABLE BOX

(71) Applicant: Michael Avila, Los Angeles, CA (US)

(72) Inventor: Michael Avila, Los Angeles, CA (US)

( * ) Notice: Subject to any disclaimer, the term of this patent is extended or adjusted under 35 U.S.C. 154(b) by 108 days.

(21) Appl. No.: 17/318,813

(22) Filed: May 12, 2021

Related U.S. Application Data

(60) Provisional application No. 63/028,023, filed on May 21, 2020.

(51) Int. Cl.

| | |
|---|---|
| ***B65D 5/20*** | (2006.01) |
| ***B65D 5/30*** | (2006.01) |
| ***B65D 5/42*** | (2006.01) |
| ***B65D 5/00*** | (2006.01) |

(52) U.S. Cl.
CPC ..... *B65D 5/2061* (2013.01); *B65D 5/003* (2013.01); *B65D 5/301* (2013.01); *B65D 5/4204* (2013.01)

(58) Field of Classification Search
CPC ..... B65D 5/20; B65D 5/42; B65D 5/4204; B65D 5/2057; B65D 5/241; B65D 5/003; B65D 5/301; B65D 5/2061; B65D 25/005; B65D 71/0096; B65D 11/1833
USPC ..... 229/155; 206/775, 503, 509, 600; 220/23.6
See application file for complete search history.

(56) References Cited

U.S. PATENT DOCUMENTS

| | | | | |
|---|---|---|---|---|
| 4,877,137 | A | 10/1989 | Govang et al. | |
| 5,285,900 | A | 2/1994 | Swingler | |
| 6,253,948 | B1 | 7/2001 | Ficker | |
| 7,637,372 | B2 * | 12/2009 | Keel | B65D 5/4204 206/509 |
| 8,091,715 | B2 | 1/2012 | Roth | |
| 8,317,039 | B2 | 11/2012 | Norman | |
| 8,960,469 | B1 | 2/2015 | Helal et al. | |
| 8,998,073 | B2 | 4/2015 | De Beer | |
| 9,370,264 | B2 | 6/2016 | Markee | |
| 9,382,032 | B2 | 7/2016 | Kelly | |
| 9,873,543 | B2 * | 1/2018 | Earnshaw | B65D 5/248 |
| 10,315,798 | B2 | 6/2019 | Pfeifer et al. | |
| 10,351,295 | B2 | 7/2019 | Van Der Korput | |

(Continued)

FOREIGN PATENT DOCUMENTS

| | | |
|---|---|---|
| EP | 0356543 | 3/1990 |
| RU | 120948 | 10/2012 |

*Primary Examiner* — King M Chu
(74) *Attorney, Agent, or Firm* — The Patent Professor, P.A.; John Rizvi

(57) ABSTRACT

The present invention is directed to securely stackable, box pallet merchandising storage and display box and system for use in storing and displaying clothing or other merchandising goods. The merchandising display box generally includes a bottom panel, U-shaped front panel foldably connected to the bottom panel and defining a display opening and a rear panel also foldably connected to the bottom panel. First and second side panels are further foldably connected to the bottom panel and include securing flaps for securing the first and second side panels to the front and rear panels. Projections extend upwardly from the first and second side panels and cutouts are formed along bottom edges of the first and second side panels. The projections are configured to engage cutouts formed in a second merchandising display box positioned on top of the merchandising display box to secure or lock the merchandising display boxes together to prevent slippage therebetween.

26 Claims, 7 Drawing Sheets

(56) References Cited

U.S. PATENT DOCUMENTS

| | | | | |
|---|---|---|---|---|
| 10,442,571 | B2 | 10/2019 | Hulzingh et al. | |
| 2004/0124111 | A1 | 7/2004 | Bevier | |
| 2006/0054674 | A1 | 3/2006 | Meyer | |
| 2009/0032432 | A1 | 2/2009 | Kostos et al. | |
| 2010/0314435 | A1 | 12/2010 | Goodman | |
| 2010/0320109 | A1 | 12/2010 | Trumbauer et al. | |
| 2013/0320006 | A1 | 12/2013 | Orgeldinger | |
| 2015/0336706 | A1* | 11/2015 | Smith | B65D 5/22 229/109 |
| 2016/0122073 | A1* | 5/2016 | Aguirre | B65D 5/443 206/509 |
| 2017/0361982 | A1 | 12/2017 | Kelly | |
| 2019/0008290 | A1 | 1/2019 | Ertl | |
| 2019/0075942 | A1 | 3/2019 | Volz et al. | |

* cited by examiner

STACKABLE AND FOLDABLE BOX

CROSS-REFERENCE TO RELATED APPLICATION

This application claims the benefit of U.S. Provisional Patent Application No. 63/028,023, filed on May 21, 2020, which is incorporated herein by reference in its entirety.

FIELD OF THE INVENTION

The present invention relates generally to merchandise display systems, and more particularly, to a foldable and stackable cardboard merchandise box and system.

BACKGROUND OF THE INVENTION

It is often desirable in stores to display merchandise in shelves or racks for the customers' ease of viewing and access. Oftentimes, the merchandise is arranged in boxes stacked one on top of another to conserve space and provide a novel or unique way of displaying the merchandise. Additionally, it is often desirable to store merchandise in easily visible shelves or racks for ease of access by employees when selecting items for a customer to view or when filling customers' orders from warehouse storage.

Some of the types of boxes used to display merchandise in this manner include metal or plastic milk crates, open-faced cardboard boxes, etc. Unfortunately, the milk crates and cardboard boxes are typically incapable of being easily secured together resulting in the boxes falling off of each other as the customers remove the merchandise. Additionally, the milk crates are rigid and permanently formed and cannot be easily stored without taking up a lot of space.

Cardboard boxes are even more prone to slip or fall off each other as the merchandise is handled. In order to prevent the cardboard boxes from falling relative to each other, various types of rack systems are needed to secure the cardboard boxes in place.

Accordingly, there is need for a solution to at least one of the aforementioned problems. For instance, there is an established need for cardboard merchandise storage and display boxes that can be stacked one on top of another without the need for a separate rack system. There is a further established need for such a merchandise display box that can be easily and economically stored prior to use.

SUMMARY OF THE INVENTION

The present invention is directed to a securely stackable merchandising storage and display box for use in displaying clothing or other merchandising goods. The merchandising storage and display box generally includes a bottom panel, U-shaped front panel foldably connected to the bottom panel and defining a display opening and a rear panel also foldably connected to the bottom panel. First and second side panels are further foldably connected to the bottom panel and include securing flaps for securing the first and second side panels to the front and rear panels. Projections extend upwardly from the first and second side panels and cutouts are formed along bottom edges of the first and second side panels. The projections are configured to engage cutouts formed in a second merchandising display box positioned on top of the merchandising display box to secure or lock the merchandising display boxes together to prevent slippage therebetween.

In a first implementation of the invention, a stackable and foldable box may include a bottom panel, a front panel, a rear panel, a left side panel, and a right side panel. In an assembled configuration of the box, the bottom panel may be generally horizontal, and the front panel, rear panel, left side panel and right side panel may be foldably connected to a front edge, a rear edge, a left side edge, and a right side edge of the bottom panel, respectively, and may be arranged in a generally vertical orientation. The bottom panel, front panel, rear panel, left side panel and right side panel may define an interior space of the box, and the front panel may include a front opening in communication with the interior space. The box may further include a left securing flap, which may be arranged generally horizontally at a top left side of the box. The left securing flap may connect the front panel, the rear panel and the left side panel to one another and may provide a first top horizontal surface. The box may further include a right securing flap, which may be arranged generally horizontally at a top right side of the box. The right securing flap may connect the front panel, the rear panel and the right side panel to one another and may provide a second top horizontal surface coplanar to the first top horizontal surface. One or more left side projections may extend upward of a left end of the first top horizontal surface, and one or more cutouts may be formed in a vertically opposite, bottom left end of the box. Each left side projection of the one or more left side projections has may have a shape and size configured to fit inside a respective cutout of the one or more cutouts arranged vertically opposite to each left side projection. One or more right side projections may extend upward of a right end of the second top horizontal surface, and one or more cutouts may be formed in a vertically opposite, bottom right end of the box. Each right side projection of the one or more right side projections may have a shape and size configured to fit inside a respective cutout of the one or more cutouts arranged vertically opposite to each right side projection.

In a second aspect, the front panel, rear panel, left side panel, and right side panel may be foldable relative to the bottom panel to adopt a flat configuration in which the front panel, rear panel, left side panel and right side panel are coplanar.

In another aspect, the front panel may include a bottom portion, a first side portion extending upwardly from a left end of the bottom portion and a second side portion extending upwardly from a right end of the bottom portion in a spaced-apart relationship with the first side portion. The first side portion, second side portion and bottom portion may form a U-shaped arrangement and define the front opening therebetween. The front opening may extend to a top of the front panel.

In another aspect, the stackable and foldable box may further include a front support panel, which may include a first edge foldably connected to a top edge of the bottom portion of the front panel. The front support panel may be folded against an inner side of the bottom portion of the front panel. One or more tabs provided at a second edge of the front support panel may be received in respective one or more slots, which may be formed at a front edge of the bottom panel.

In another aspect, the front support panel may be foldable relative to the bottom portion of the front panel to adopt a coplanar relationship with the front panel.

In yet another aspect, the left securing flap may be foldably connected to the left side panel.

In another aspect, the one or more left side projections may include at least one projection formed along the left side panel upon folding the left securing flap out of a coplanar relationship with the left side panel.

In another aspect, the stackable and foldable box may further include a first side engagement flap and a second side engagement flap foldably connected to a front edge and a rear edge of the left securing flap. The first side engagement flap and second side engagement flap may be arranged extending downward and over the front panel and rear panel, respectively, and may be secured to the front panel and rear panel, respectively.

In another aspect, the first side engagement flap and the second side engagement flap may be foldable relative to the left securing flap to adopt a coplanar relationship with the left securing flap.

In yet another aspect, the first side engagement flap and the second side engagement flap may include a respective securing tab. The securing tab of the first side engagement flap may be inserted through a relatively smaller slot formed in the front panel to secure the first side engagement flap to the front panel. The securing tab of the second side engagement flap may be inserted through a relatively smaller slot formed in the rear panel to secure the second side engagement flap to the rear panel.

In another aspect, the right securing flap may be foldably connected to the right side panel.

In another aspect, the one or more right side projections may include at least one projection formed along the right side panel upon folding the right securing flap out of a coplanar relationship with the right side panel.

In another aspect, the stackable and foldable box may further include a first side engagement flap and a second side engagement flap foldably connected to a front edge and a rear edge of the right securing flap. The first side engagement flap and second side engagement flap may be arranged extending downward and over the front panel and rear panel, respectively, and may be secured to the front panel and rear panel, respectively.

In yet another aspect, the first side engagement flap and the second side engagement flap may be foldable relative to the right securing flap to adopt a coplanar relationship with the right securing flap.

In another aspect, the first side engagement flap and the second side engagement flap may include a respective securing tab. The securing tab of the first side engagement flap may be inserted through a relatively smaller slot formed in the front panel to secure the first side engagement flap to the front panel. The securing tab of the second side engagement flap may be inserted through a relatively smaller slot formed in the rear panel to secure the second side engagement flap to the rear panel.

In another aspect, the left securing flap and the right securing flap may define a top opening therebetween, the top opening in communication with the interior space.

In another aspect, the top opening may be arranged in continuation of the front opening.

In yet another aspect, the top opening may extend to a top edge of the rear panel.

In another aspect, the stackable and foldable box may further include a first left side flap foldably connected to a vertical left edge of the front panel, and a second left side flap foldably connected to a vertical left edge of the rear panel. The first and second left side flaps may be folded to form a right angle relative to the front panel and rear panel, respectively, and may be arranged against an inner side of the left side panel to support the left securing flap.

In another aspect, the one or more left side projections may include a projection extending from the first left side flap and a projection extending upward from the second left side flap.

In another aspect, the first left side flap and second left side flap may be foldable relative to the front panel and rear panel, respectively, to adopt a coplanar relationship with the front panel and rear panel, respectively.

In yet another aspect, the stackable and foldable box may further include a first right side flap foldably connected to a vertical right edge of the front panel, and a second right side flap foldably connected to a vertical right edge of the rear panel. The first and second right side flaps may be folded to form a right angle relative to the front panel and rear panel, respectively, and may be arranged against an inner side of the right side panel to support the right securing flap.

In another aspect, the one or more right side projections may include a projection extending from the first right side flap and a projection extending upward from the second right side flap.

In another aspect, the first right side flap and second right side flap may be foldable relative to the front panel and rear panel, respectively, to adopt a coplanar relationship with the front panel and rear panel, respectively.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward inexpensive and easily assembled merchandising storage and display boxes which can be securely stacked one on top of another and may be self-maintained in the securely stacked condition without the need for a separate rack system.

Figure 1:
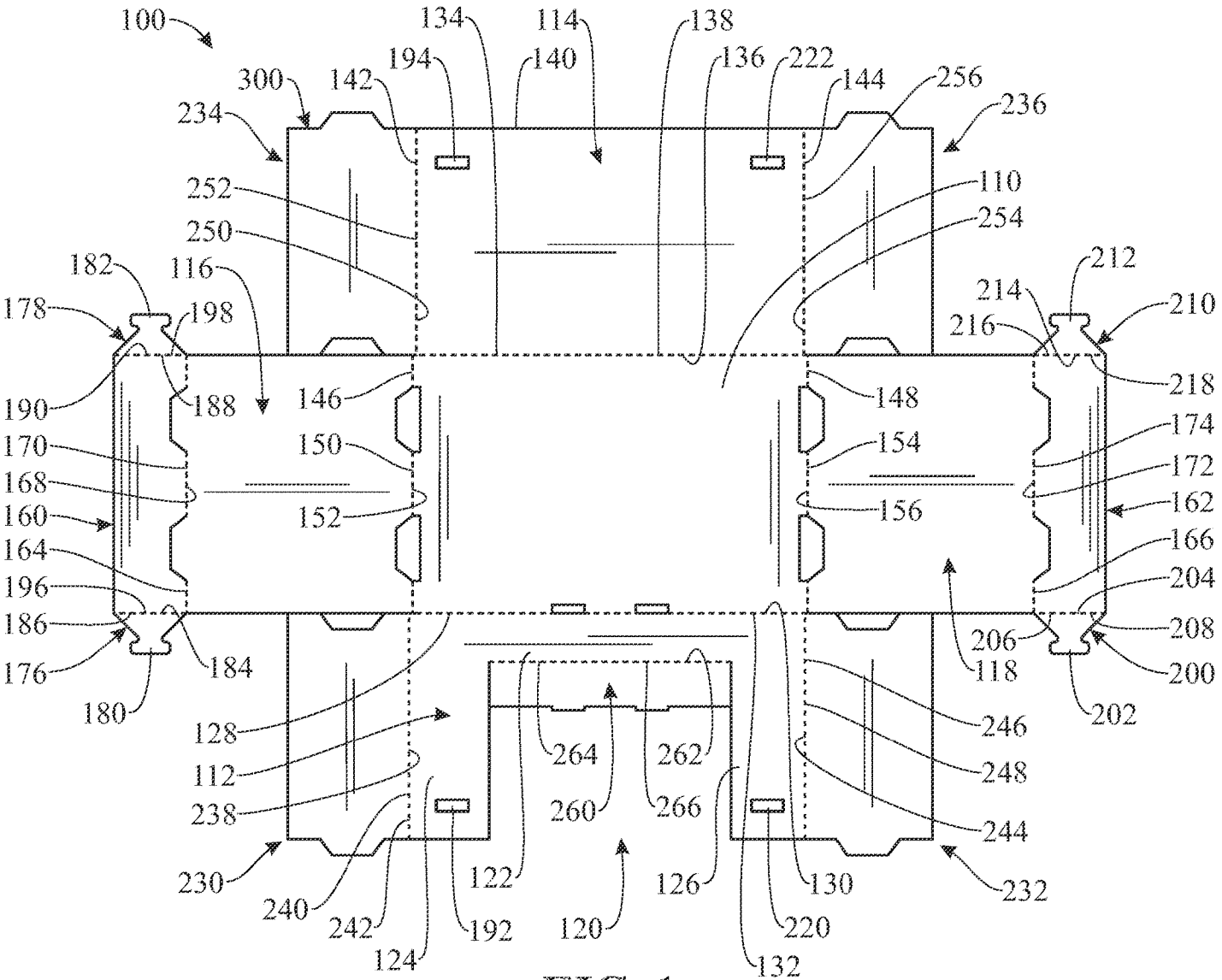
FIG. 1 presents a top plan view of a merchandising display box, in a pre-assembled condition, in accordance with a preferred embodiment of the present invention.
Figure 2:
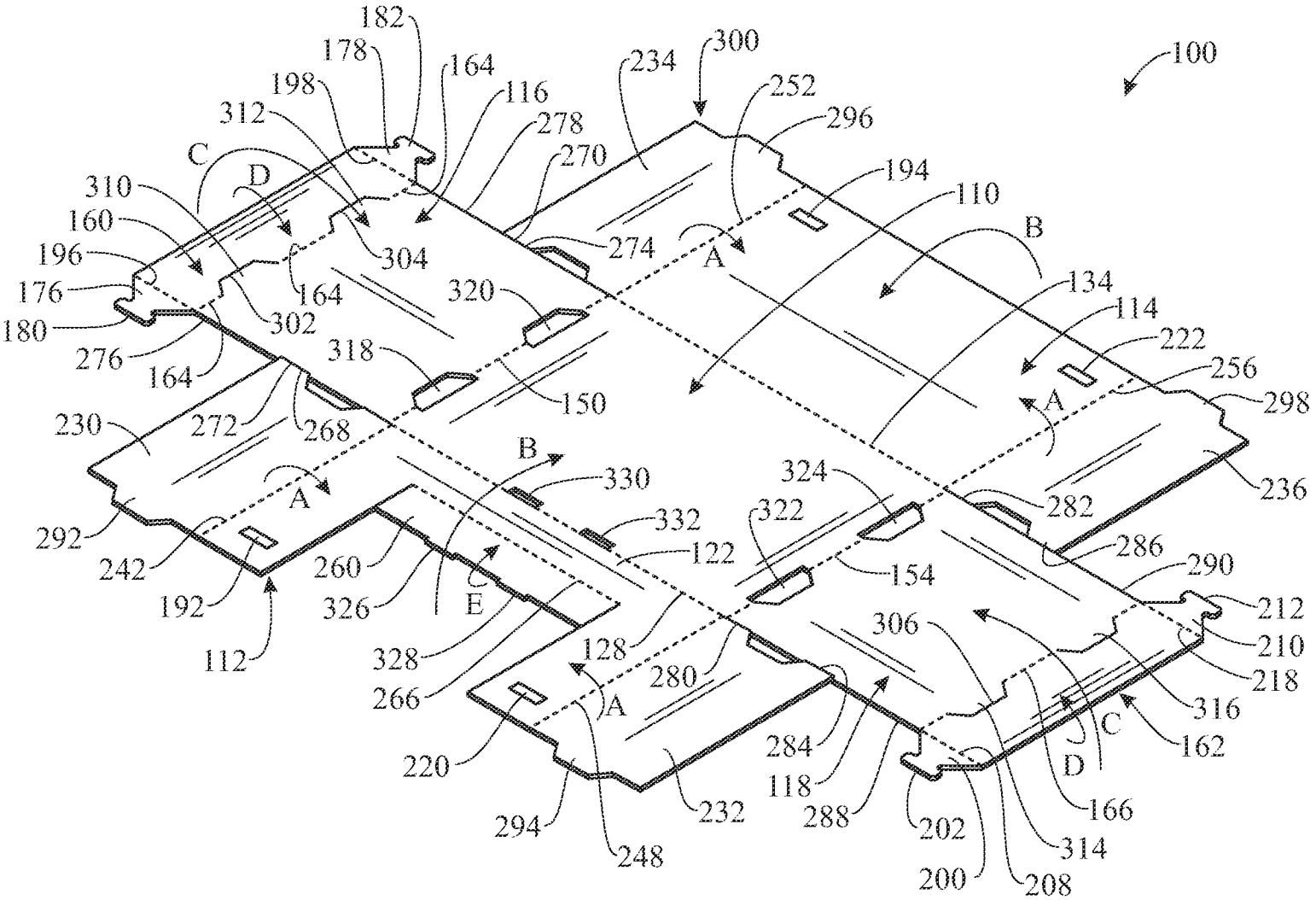
FIG. 2 presents an isometric view of the merchandising display box illustrated in FIG. 1 during initial assembly.

Referring initially to FIGS. 1 and 2, there is disclosed a foldable, merchandising storage and display box or display box 100 in accordance with a preferred embodiment of the present invention, shown in an initial, flat or unfolded condition. The display box 100 generally includes a bottom panel 110, a generally U-shaped front panel 112 and a rear panel 114 both foldably connected to the bottom panel 110. The display box 100 additionally includes a first or left side panel 116 and a second or right side panel 118, which are also foldably connected to the bottom panel 110 in a manner described in more detail hereinbelow. Together, the bottom panel 110, the front and rear panels 112 and 114, and the left and right side panels 116 and 118, when assembled, form the stackable merchandising display box 100 for displaying clothing or other saleable wares.

Figure 3:
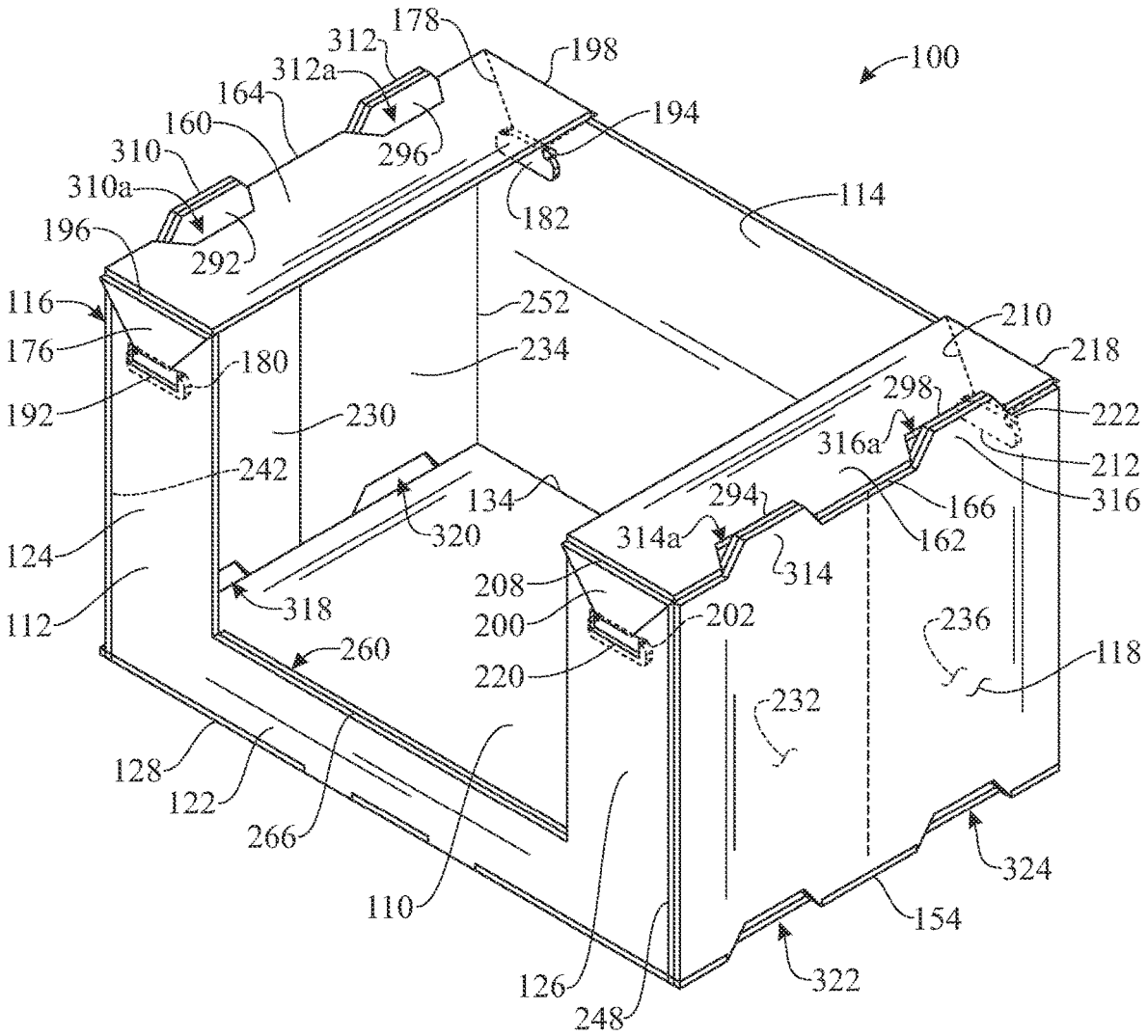
FIG. 3 presents an top, front isometric view of a fully assembled merchandising display box of the present invention.

As noted above, the front panel 112 is generally U-shaped and defines a display window or front opening 120. The front panel 112 includes a bottom portion 122 and first and second upright portions 124 and 126 which extend upwardly from the bottom portion 112 when the display box 100 is fully assembled (FIG. 3). The front panel 112 is foldably attached to the bottom panel 110 along a fold line 128. Specifically, a bottom edge 130 of the front panel 112 is formed adjacent a forward edge 132 of the bottom panel 110 and along the fold line 128. The intersection of the adjacent bottom edge 130 of the front panel 112 and the forward edge 132 of the bottom panel 110, along the fold line 128, may be perforated, scored or otherwise formed to facilitate folding the front panel 112 relative to the bottom panel 110 as described hereinbelow.

Likewise, the rear panel 114 is foldably formed adjacent the bottom panel 110 along a fold line 134 such that a bottom edge 136 of the rear panel 114 is adjacent a rearward edge 138 of the bottom panel 110. The rear panel 114 additionally includes a top edge 140 and first or left side edge 142, and a second or right side edge 144. The bottom panel also includes first and second or left and right side edges 146 and 148.

The front panel 112 and the rear panel 114 are foldably connected to the bottom panel 110 in order to be folded up relative to the bottom panel 110 from an initial or un-assembled condition to an assembled condition to form the fully assembled merchandising display box 100. Similarly, the left side panel 116 is foldably connected to the bottom panel 110 along a fold line 150. A bottom edge 152 of the left side panel 116 is foldably connected to the left side edge 146 of the bottom panel 110 along the fold line 150. The right side panel 118 is likewise foldably connected to the bottom panel 110 along a fold line 154 such that a bottom edge 156 of the right side panel 118 is foldably connected to the right side edge 148 of the bottom panel 110. The left and right side panels 116 and 118, respectively, are also foldable relative to the bottom panel 110 from the un-assembled condition to the fully assembled condition to, along with the front panel 112 and rear panel 114, fully form the fully assembled merchandising display box 100. The initial or un-assembled condition of the bottom, front, rear, left side and right side panels 110, 112, 114, 116 and 118, respectively, may be generally flat, as shown in FIGS. 1 and 2, i.e. with each one of the front, rear, left side and right side panels 112, 114, 116 and 118 forming an angle of substantially 180 degrees with the bottom panel 110.

In order to secure the front panel 112, the rear panel 114 and the left and right side panels 116 and 118, respectively, in the folded up or fully assembled condition relative to the bottom panel 110, the left and right side panels 116 and 118 include respective left and right securing flaps 160 and 162. The left and right securing flaps 160 and 162 are provided to engage the front and rear panels 112 and 114 in order to secure the merchandising display box 100 in the fully assembled condition. The left securing flap 160 is foldably connected to the left side panel 116 along a fold line 164 and the right side panel 118 is foldably connected to the right side panel 118 along a fold line 166.

Specifically, a bottom edge 168 of the left securing flap 160 is foldably connected to a top edge 170 of the left side panel 116 and a bottom edge 172 of the right securing flap 162 is foldably connected to a top edge 174 of the right side panel 118. The left and right securing flaps 160 and 162, respectively, are foldable inwardly relative to the left and right side panels 116 and 118 in order to reinforce and strengthen the top edges 170 and 174 of the left and right side panels 116 and 118 as well as secure the top edges 170 and 174 to the front and rear panels 112 and 114.

In order to secure the left securing flap 160 to the front and rear panels 112 and 114, the left securing flap 160 includes first and second side engagement flaps 176 and 178. The first and second side engagement flaps 176 and 178 may be generally triangularly shaped and may terminate in enlarged first and second securing tabs 180 and 182. The first and second side engagement flaps 176 and 178 are foldably connected to the left securing flap 160. Specifically, an inner edge 184 of the first side engagement flap 176 is foldably connected to a front side edge 186 of the left securing flap 160 and an inner edge 188 of the second side engagement flap 178 is foldably connected to a rear side edge 190 of the left securing flap 160. The first and second securing tabs 180 and 182 are provided to engage corresponding respective slots 192 and 194 formed in the front and rear panels 112 and 114, respectively. For example, the first securing tab 180 is provided to engage the slot 192 formed in the first side portion 124 of the front panel 112 and the second securing tab 182 is provided to engage the slot 194 formed adjacent the top edge 140 and the left side edge 142 of the rear panel 114. As with other elements of the merchandising display box 100, the first side engagement flap 176 is foldably connected to the front side edge 186 of the left securing flap 160 along a fold line 196 and the second side engagement flap 178 is foldably connected to the rear side edge 190 of the left securing flap along a fold line 198.

Similarly, the right securing flap 162 includes a first side engagement flap 200 terminating in a first securing tab 202 and having an inner edge 204 foldably connected to a front side edge 206 of the right securing flap 162 along a fold line 208. The right securing flap 162 further includes a second side engagement flap 210 terminating in a second securing tab 212 and having an inner edge 214 foldably connected to a rear side edge 216 of the right side securing flap 162 along a fold line 218. The first securing tab 202 is provided to engage a slot 220 formed in the second side portion 126 of the front panel 112 and the second securing tab 212 is provided to engage a slot 222 formed adjacent the top edge 140 and right side edge 144 of the rear panel 114.

The merchandising display box 100 further includes a left side flap 230 and a right side flap 232 both foldably connected to the front panel 112 at left and right sides thereof, respectively. Similarly, the merchandising display box also includes a left side flap 234 and a right side flap 236 both foldably connected to left and right sides of the rear panel 114, respectively. The side flaps 230, 232, 234 and 236 may strengthen the fully assembled merchandising display box 100 to enhance the ability to stack two or more merchandising display boxes 100 on top of each other. The left side flap 230 includes an inner edge 238 foldably connected to a first or left side edge 240 of the front panel 112 along a fold line 242 and the right side flap 232 includes an inner edge 244 foldably connected to a second or right side edge 246 of the front panel 112 along a fold line 248. Likewise, the left side flap 234 includes an inner edge 250 foldably connected to the first or left side edge 142 of the rear panel 114 along a fold line 252. The right side panel 236 includes an inner edge 254 foldably connected to the second or right side edge 144 of the rear panel 114 along a fold line 256. The left and right side flaps 230 and 232 may extend generally to the bottom edge 130 of the front panel 112, such that, when the flaps 230 and 232 are folded onto the front panel 112 about the respective fold lines 242 and 248, the flaps 230 and 232 generally rest on the bottom panel 110 in the area of the fold line 128. Similarly, the left and right side flaps 234 and 236 may extend generally to the bottom edge 136 of the rear panel 114, such that, when the flaps 234 and 236 are folded onto the rear panel 114 about the respective fold lines 252 and 256, the flaps 234 and 236 generally rest on the bottom panel 110 in the area of the fold line 134.

With continued reference to FIG. 1, the merchandising display box 100 further includes a front support panel 260 foldably connected to the bottom portion 122 of the front panel 112. The front support panel 260 includes a lower edge 262 foldably connected to an upper edge 264 of the bottom portion 122 of the front panel 112 along a fold line 266. The front support panel 260 is provided to reinforce the front panel 112 as merchandise is moved into and out of the merchandising display box 100. In the unfolded state shown in the figure, the front support panel 260 may be connected to the upper edge 264 of the bottom portion 122 along the entire length thereof, i.e. may extend from the first side position 124 to the second side portion 126 of the front panel 112.

Turning now to FIG. 2, the merchandising display box 100 is formed from a relatively inexpensive and lightweight material such as, but not limited to, cardboard, plastic (e.g., corrugated plastic), combinations thereof, etc. Preferably, the merchandising display box 100 is formed from an initial sheet of material, and more preferably, from a sheet of corrugated cardboard. The sheet can be formed into the flat and un-assembled condition of FIGS. 1 and 2 by various means such as, but not limited to, machine die cutting, laser cutting, hand cutting with implements such as scissors, knives, saws, etc.

For example, a sheet of cardboard or another material may be shaped into the initial or un-assembled configuration of FIGS. 1 and 2 by die cutting the outer periphery 300 of the initially flat merchandising display box 100. The slots 192 and 220 in the front panel 112 and the slots 194 and 232 in the rear panel are stamped or cut out of the sheet of cardboard material. Additionally, cuts 268 and 270 are made between bottom edges 272 and 274 of the left side flaps 230 and 234, respectively, and first and second side edges 276 and 278 of the left side panel 116. Similarly, cuts 280 and 282 are formed between bottom edges 284 and 286 of the right side flaps 232 and 236 and first and second side edges 288 and 290 of the right side panel 118.

The fold lines 128, 134, 150, 154, 164, 166, 196, 198, 208, 218, 242, 248, 252, 256 and 266 may be formed by pressing, stamping, die impressing or other means to slightly weaken the line area to allow folding of the merchandising display box material 100 along the fold lines while providing material continuity between each pair of adjacent panels or panel sections connected at each respective fold line.

As further shown in FIG. 2, projections 292 and 296 extend from the left side flaps 230 and 234 of the front panel 112 and rear panel 114, respectively. Similarly, projections 294 and 298 extend from the right side flaps 232 and 236 of the front panel 112 and rear panel 114, respectively. For purposes that will be described hereinafter, the projections 292 and 296 of the left side flaps 230 and 234, respectively, are configured to substantially vertically register with the fold line 150 between the left side panel 116 and the bottom panel 110 when the merchandising display box 100 is folded into the assembled configuration. In turn, the projections 294 and 298 of the right side flaps 232 and 236, respectively, are configured to substantially vertically register with the fold line 154 between the right side panel 118 and the bottom panel 110 when the merchandising display box 100 is folded into the assembled configuration.

With continued reference to FIG. 2, the fold line 164 between the left securing flap 160 and the left side panel 116 may be discontinuous or interrupted, and cutouts 302 and 304 may be formed along the fold line 164, in an alternating or interspersed relationship with the fold line 164. Similarly, the fold line 166 between the right securing flap 162 and the right side panel 118 may be discontinuous or interrupted, and cutouts 306 and 308 may be formed along the fold line 166, in an alternating or interspersed relationship with the fold line 166. The cutouts 302, 304, 306 and 308 may be pre-formed (i.e. cut through) the cardboard sheet or other material, or may be cuttable, tearable or otherwise easily formable by a user, such as by tearing along a perforated line or otherwise tearable line formed along the cutouts 302, 304, 306 and 308. In embodiments in which the cutouts 302, 304, 306 and 308 are tearable, cuttable or otherwise formable by the user, the fold lines 164 and 166 are preferably formed by a different scoring or otherwise foldable structure that is significantly more difficult to tear than the cutouts 302, 304, 306 and 308 such that tearing of the cutouts does not continue along the fold lines 164 and 166; for instance and without limitation, the cutouts 302, 304, 306 and 308 may be formed by perforated lines (perforated through the material) while the fold lines 164 and 166 may be formed by a scored line recessed into the sheet but not extending through the sheet. Each cutout 302, 304, 306 and 308 provides a respective projection 310, 312, 314 and 316 on the left and right side panels 116 and 118, respectively; as will be shown hereinafter, the projections 310, 312, 314 and 316 are formed when the left and right securing flaps 160 and 162 are pivoted relative to the left and right side panel 116 and 118 about the fold lines 164 and 166, respectively.

Figure 4:
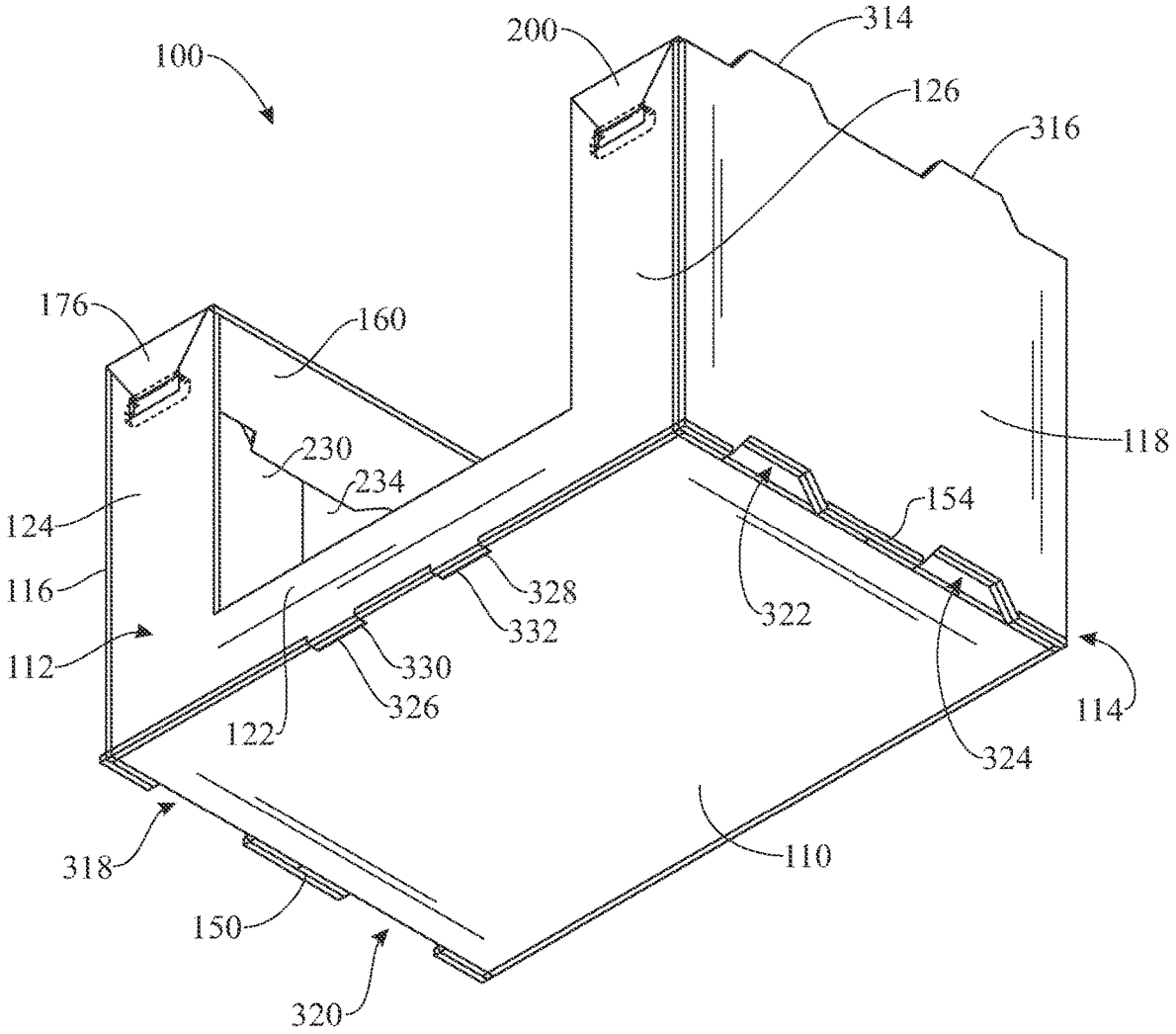
FIG. 4 presents a bottom, front isometric view of the fully assembled merchandising display box of the present invention.

Turning to FIGS. 2-4, the assembly of the merchandising display box 100 from the substantially flat, un-assembled condition of FIG. 2 to the fully assembled condition of FIGS. 3 and 4 will now be described. With reference initially to FIG. 2, the left and right side flaps 230 and 232 and the left and right side flaps 234 and 236 are folded inwardly in the direction of arrows "A" along fold lines 242, 248 and 252 and 256, respectively, so that the left side flaps 230 and 234 are no longer coplanar with the left side panel 116 and the right side flaps 232 and 236 are no longer coplanar with the right side panel 118. The front panel 112 and the rear panel 114 are then folded in the direction of arrows "B" along respective fold lines 128 and 134, to an upright condition in which the front and rear panels 112 and 114 are substantially perpendicular to the bottom panel 110. Once the front and rear panels 112 and 114, respectively are in the upright condition, the left and right side panels 116 and 118 are folded to a similar upright condition in the direction of arrows "C" along fold lines 150 and 154 to form a box shape. The left side flaps 230 and 234, which are located inside the box shape, are then pivoted inversely to arrows "A" and about the fold lines 242 and 252, respectively, until the left side flaps 230 and 234 generally rest against the upright, left side panel 116, as shown for instance in FIG. 3. Similarly, the right side flaps 232 and 236, which are also located inside the box, are then pivoted inversely to arrows "A and about the fold lines 248 and 256, respectively, until the right side flaps 232 and 236 generally rest against the upright, right side panel 118. In this final position of the left side flaps 230 and 234 and right side flaps 232 and 236, the respective projections 292, 296, 294 and 298 are oriented vertically upward, with the projections 292 and 296 arranged substantially parallel to and in vertical registration with the fold line 150 and the projections 294 and 298 arranged substantially parallel to and in vertical registration with the fold line 154.

Once the left side flaps 230 and 234 are positioned against the left side panel 116 and the right side flaps 232 and 236 are positioned against the right side panel 118 on the inside of the box, the left securing flap 160 and the right securing flap 162 are folded over inwardly in the direction of arrows "D" along the fold lines 164 and 166, respectively, to a generally horizontal position shown in FIG. 3. As the left and right securing flaps 160 and 162 are folded down, the projections 310, 312, 314 and 316 remain in the upright position, and respective openings 310*a*, 312*a*, 314*a*, 316*a* are formed between the folding flaps 160 and 162 and the projections 310, 312, 314, 316. As the left and right securing flaps 160 and 162 pivot downward and toward the horizontal position, the openings 310*a*, 312*a*, 314*a*, 316*a* pivot over the projections 292, 296, 294 and 298 of the left side flaps 230 and 234 and right side flaps 232 and 236, respectively, such that the projections 292, 296, 294 and 298 extend through and upward of the respective openings 310*a*, 312*a*, 314*a*, 316*a*. Furthermore, it must be noted that each projection 292, 296, 294 and 298 is arranged adjacent to, and preferably against, a respective one of the projections 310, 312, 314 and 316.

The first and second side engagement flaps 176 and 178 of the left securing flap 160 are folded downward and over the first side portion 124 of the front panel 112 and the rear panel 114, and about the fold lines 196 and 198, respectively, and the first and second securing tabs 180 and 182 are secured within the slots 192 and 194 formed through the front and rear panels 112 and 114, respectively. Similarly, the first and second side engagement flaps 200 and 210 of the right securing flap 162 are folded downward and over the second side portion 126 of the front panel 112 and the rear panel 114, and about the fold lines 208 and 218, respectively, and the first and second securing tabs 202 and 212 are secured within the slots 220 and 222 formed through the front and rear panels 112 and 114, respectively. Finally, the front support panel 260 is folded over in the direction of arrow "E" along fold line 266 substantially onto an inner side of the bottom portion 122 of the front panel 112, as shown in FIG. 3, and tabs 326 and 328 extending from the front support panel 260 opposite to the fold line 266 are secured within slots 330 and 332 formed generally at the fold line 128 to secure the front support panel 260 in a vertical position in which the support panel 260 provides additional robustness to the bottom portion 122 of the front panel 112.

The illustrations of FIGS. 3 and 4 show the merchandising display box 100 in the final, assembled position. As shown, in this final assembled position, the front panel 112, rear panel 114, left side panel 116, right side panel 118, left side flaps 230 and 234, right side flaps 232 and 236, and front support panel 260 are arranged perpendicular to the bottom panel 110 and forming the aforementioned box. The flat, bottom panel 110 may stably rest on a flat surface. The left and right securing flaps 160 and 162 are arranged elevated from and parallel to the bottom panel 110. It must be noted that the flaps 230, 234, 232 and 236 have substantially the same height as the panels 112, 114, 116 and 118, and thus reinforce the area of the left and right side panels 116 and 118. Furthermore, because the left and right securing flaps 160 and 162 are in material continuity with the left and right side panels 116 and 118, respectively, and also secured to the front and rear panels 112 and 114 (via the aforementioned engagement between the securing tabs and slots), the left and right securing flaps 160 and 162 further stabilize and prevent movement of the panels 112, 114, 116, 118 relative to each other.

As further shown in FIGS. 3 and 4, the box-shaped, assembled merchandising display box 100 defines an interior cavity or space 340 for storing items. The interior space 340 is, more specifically, defined by the bottom panel 110, front panel 112, rear panel 114, left side flaps and panel 230, 234 and 116, respectively, and the right side flaps and panel 232, 236 and 118, respectively. The aforementioned display window or front opening 120 is formed in the front panel 112, between the first side portion 124 and right side portion 126, and above the bottom portion 122. In turn, a top opening 342 is formed in a top side of the box, between the left securing flap 160 and the right securing flap 162, and frontward of a top edge of the rear panel 114. Both the front opening 120 and the top opening 342 provide access to the interior space 340. In some embodiments, such as the present embodiment, the front opening 120 and top opening 342 are communicated with one another to further facilitate inserting and removing items into and from the merchandising display box 100.

Figure 5:
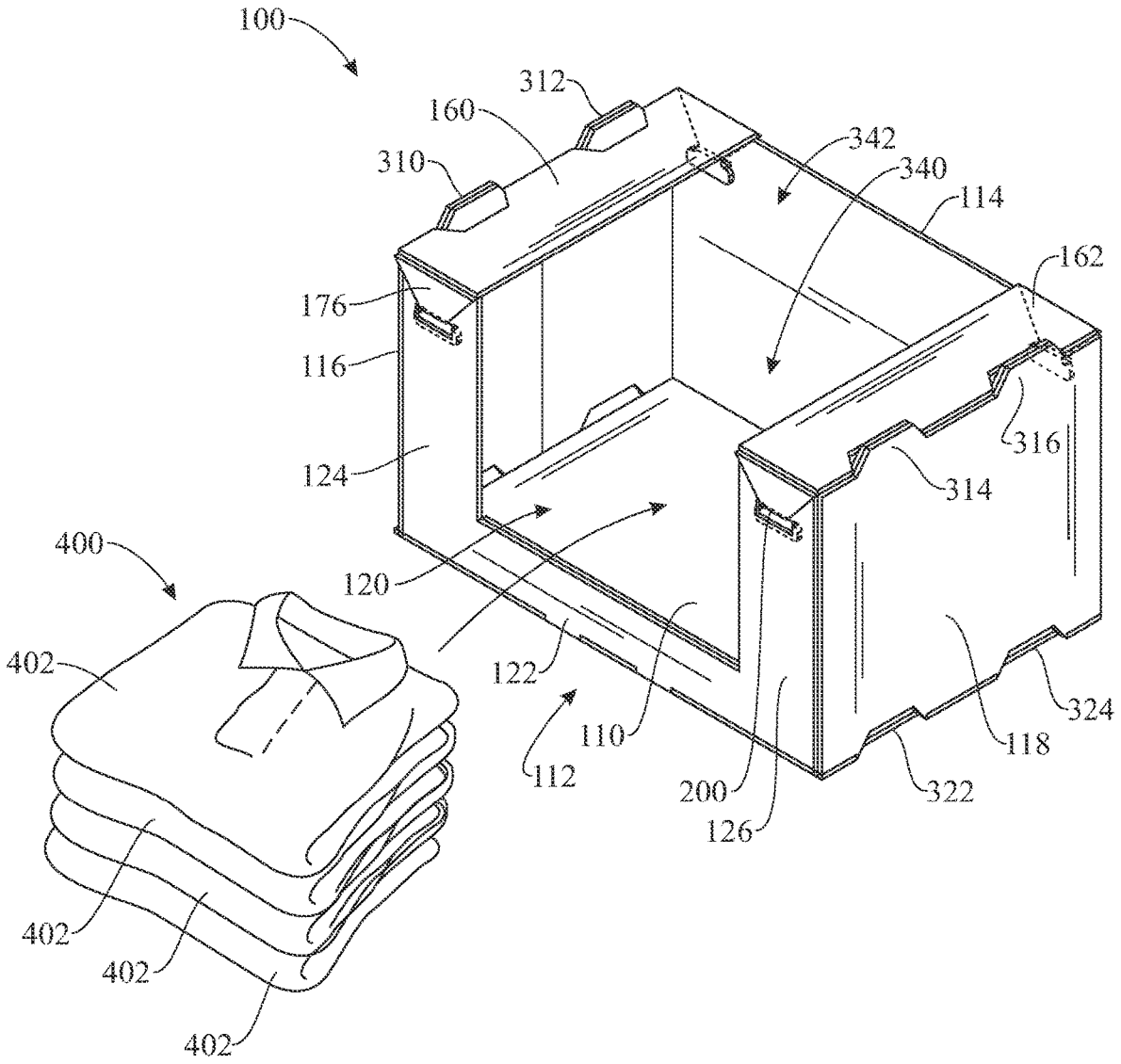
FIG. 5 presents a top, front isometric view, similar to FIG. 3, of the merchandising display box of the present invention illustrating the loading of garments into the box for display.
Figure 6:
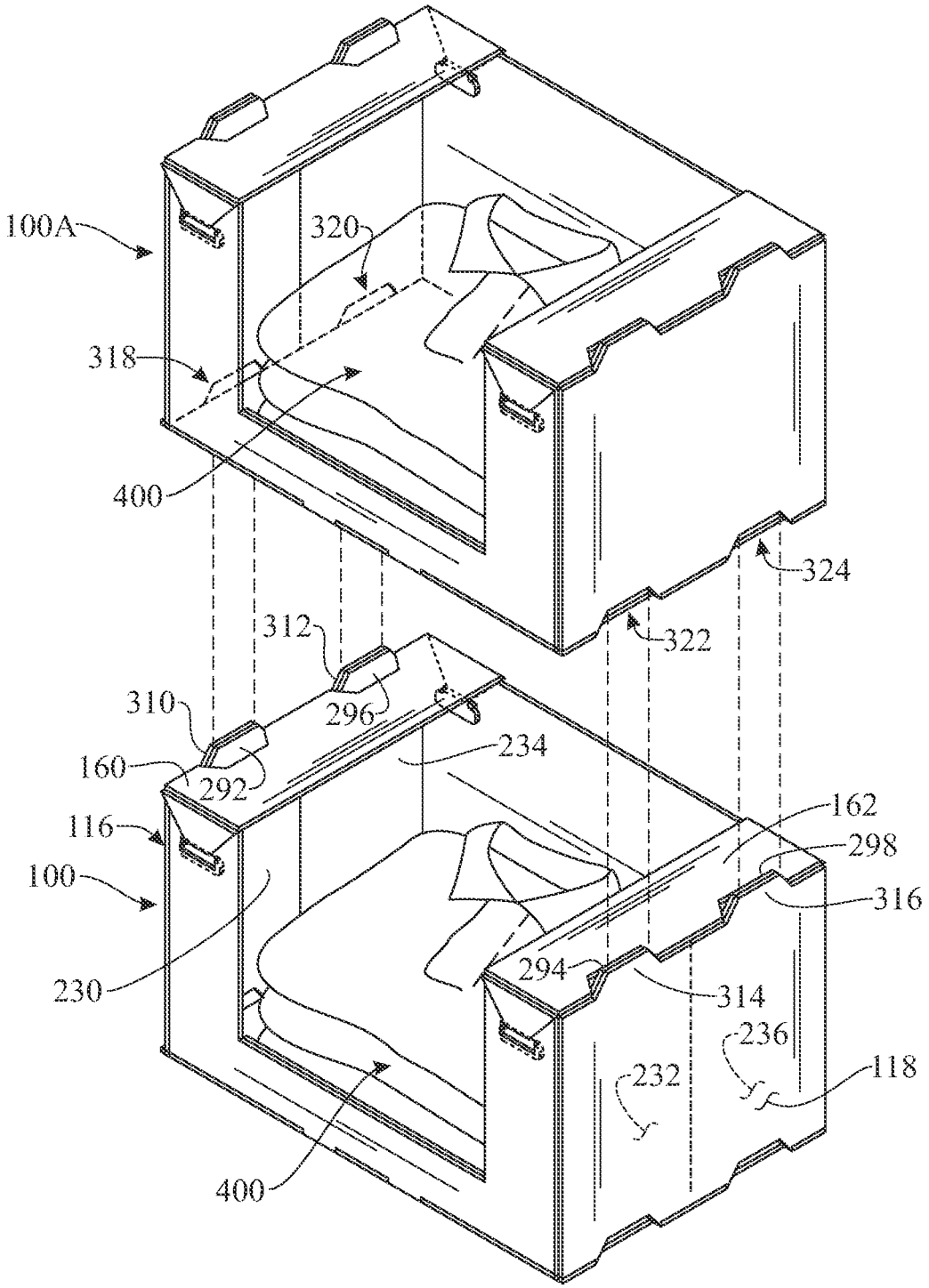
FIG. 6 presents an isometric view of two merchandising display boxes of the present invention, loaded with garments, being securely stacked one upon another.
Figure 7:
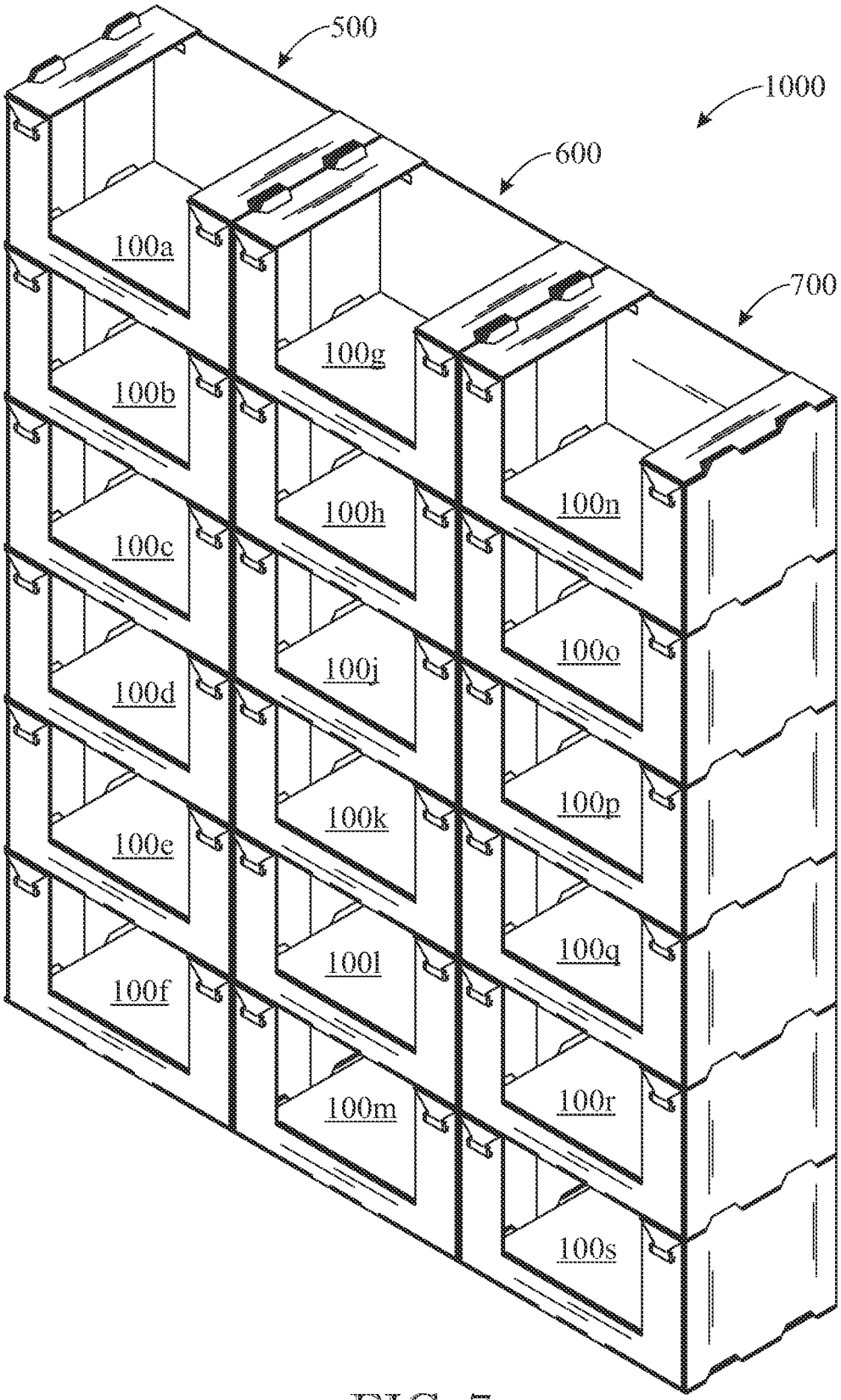
FIG. 7 is an isometric view of multiple merchandising display boxes of the present invention securely stacked six boxes high and in three rows across.

Referring now to FIGS. 5-7, and initially with regard to FIG. 5, in use, merchandise 400, such as, but not limited to, shirts 402, can be placed in the interior space 340 of the merchandising display box 100 by inserting them through the front opening 120 defined by the front panel 112 or, in the case of a single merchandising display box 100 (or top merchandising display box 100 in a stack of boxes), through the top opening 342. The shirts 402 can then be viewed and accessed by the customers and/or store employees through the front opening 120 or the top opening 342. As shown in FIGS. 4 and 5, the bottom portion 122 and first and second side portions 124 and 126 of the front panel 112 provide a barrier against the merchandise 400, which contributes to contain the merchandise 400 within the interior space 340 of the merchandising display box 100 and prevent the merchandise 400 from sliding out of the merchandising box 100 while still allowing the merchandise 400 to be viewed by the customer and accessed by the customer or store employee through the front opening 120 defined by the front panel 112 or the top opening 342.

With specific reference to FIG. 6, as noted hereinabove, the merchandising display box 100 of the present embodiment is designed to be arranged in a securely stacked configuration with other merchandising display boxes, for example merchandising display box 100A. Both merchandising display boxes 100 and 100A can be loaded with merchandise 400 and stacked one on top of the other, as shown for instance in the figure with merchandising display box 100A being placed on top of merchandising display box 100. The left and right side flaps 230 and 232 and the left and right side flaps 234 and 236 provide additional strength to the merchandising display box 100 to support the weight of the merchandising display box 100A. Additionally, the now folded over and generally horizontally arranged, left and right securing flaps 160 and 162 in the bottom, merchandising display box 100 provide a partial flat top surface to add additional support for the merchandising display box 100A and prevent merchandising display box 100A from tipping or falling partially inside the merchandising display box 100.

Furthermore, the first pair of adjacent projections 310 and 292 and the second pair of adjacent projections 312 and 296, both of which extend upward from the horizontally arranged, left securing flap 160, and the first pair of adjacent projections 314 and 294 and the second pair of adjacent projections 316 and 298, both of which extend upward from the horizontally arranged, right securing flap 162, are configured to be securely received within the corresponding cutouts 318, 320, 322 and 324 formed in the left and right side panels 116 and 118 of the merchandising display box 100A. This firmly secures the merchandising display box 100A on top of the merchandising display box 100 and prevents any relative lateral (left-to-right) or longitudinal (front-to-back) movement therebetween, further stabilizing the stacked arrangement between the two merchandising display boxes 100, 100A. Having the projections provided in pairs, i.e. with two projections inserted in each respective cutout, further increases durability and resistance of the stacked arrangement.

The merchandising display box 100 design allows to mount a plurality of merchandising display boxes in a matrix arrangement comprising one or more rows and one or more columns. A non-limiting example of such matrix arrangement is shown in FIG. 7, which illustrates a merchandising display system 1000 comprising a six-row by three-column matrix arrangement comprising a total of eighteen merchandising display boxes 100*a-s*. A first column 500 includes six merchandising display boxes 100*a-f* stacked on top of each other. Similarly, second and third columns 600 and 700 include a respective stack of six merchandising display boxes 100*g-m* and 100*n-s*. The columns 500, 600 and 700 are arranged in side-by-side relationship and may be placed against one another. In another example, a typical pallet system may hold thirty-six merchandising display boxes 100 arranged in a six row by six column matrix formation. The matrix arrangement of multiple merchandising display boxes provides a rack-free merchandising display solution which gives customers and/or store employees the ability to view and choose the appropriate merchandise for purchase or to fill a customer's order.

Furthermore, while not the primary purpose of the foldable merchandising display box 100, the foldable merchandising display box 100 can be unfolded from the fully assembled condition, for example shown in FIG. 3 to the flat and fully un-assembled condition as shown in FIG. 2 for ease of storage and to save store room or warehouse storage space compared to the typical rigid milk crates used for display purposes or the additional rack systems needed for other types of merchandising display boxes. In other embodiments or applications, the foldable merchandising display box 100 may be disposed after use; for this purpose, the foldable merchandising display box 100 may be manufactured including recyclable and/or recycled materials (e.g., recyclable or recycled cardboard), and more preferably manufactured solely from recycled or recyclable materials (e.g., from a single sheet made of recycled or recyclable cardboard). In different applications, the merchandise displayed may be the same or differing types of merchandise. While not specifically shown, the left and/or right side panels 116 and 118 may include cutouts or hand holds to facilitate carrying the merchandising display box 100.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A stackable and foldable box comprising:

a bottom panel, a front panel, a rear panel, a left side panel, and a right side panel, wherein the bottom panel is generally horizontal, and the front panel, rear panel, left side panel and right side panel are foldably connected to a front edge, a rear edge, a left side edge, and a right side edge of the bottom panel, respectively, and are arranged in a generally vertical orientation, and further wherein the bottom panel, front panel, rear panel, left side panel and right side panel define an interior space of the box, and the front panel comprises a front opening in communication with the interior space;

a left securing flap arranged generally horizontally at a top left side of the box, the left securing flap connecting the front panel, the rear panel and the left side panel to one another and providing a first top horizontal surface;

a right securing flap arranged generally horizontally at a top right side of the box, the right securing flap connecting the front panel, the rear panel and the right side panel to one another and providing a second top horizontal surface coplanar to the first top horizontal surface;

one or more left side projections extending upward of a left end of the first top horizontal surface, and one or more cutouts formed in a vertically opposite, bottom left end of the box, wherein each left side projection of the one or more left side projections has a shape and size configured to fit inside a respective cutout of the one or more cutouts arranged vertically opposite to said each left side projection; and one or more right side projections extending upward of a right end of the second top horizontal surface, and one or more cutouts formed in a vertically opposite, bottom right end of the box, wherein each right side projection of the one or more right side projections has a shape and size configured to fit inside a respective cutout of the one or more cutouts arranged vertically opposite to said each right side projection.

2. The stackable and foldable box of claim 1, wherein the front panel, rear panel, left side panel, and right side panel are foldable relative to the bottom panel to adopt a flat configuration in which the front panel, rear panel, left side panel and right side panel are coplanar.

3. The stackable and foldable box of claim 1, wherein the front panel comprises a bottom portion, a first side portion extending upwardly from a left end of the bottom portion and a second side portion extending upwardly from a right end of the bottom portion in a spaced-apart relationship with the first side portion, such that the first side portion, second side portion and bottom portion form a U-shaped arrangement and define the front opening therebetween, and further wherein the front opening extends to a top of the front panel.

4. The stackable and foldable box of claim 3, further comprising a front support panel comprising a first edge foldably connected to a top edge of the bottom portion of the front panel, wherein the front support panel is folded against an inner side of the bottom portion of the front panel, and further wherein one or more tabs provided at a second edge of the front support panel are received in respective one or more slots formed at a front edge of the bottom panel.

5. The stackable and foldable box of claim 4, wherein the front support panel is foldable relative to the bottom portion of the front panel to adopt a coplanar relationship with the front panel.

6. The stackable and foldable box of claim 1, wherein the left securing flap is foldably connected to the left side panel.

7. The stackable and foldable box of claim 6, wherein the one or more left side projections comprise at least one projection formed along the left side panel upon folding the left securing flap out of a coplanar relationship with the left side panel.

8. The stackable and foldable box of claim 6, further comprising a first side engagement flap and a second side engagement flap foldably connected to a front edge and a rear edge of the left securing flap, wherein the first side engagement flap and second side engagement flap are arranged extending downward and over the front panel and rear panel, respectively, and are secured to the front panel and rear panel, respectively.

9. The stackable and foldable box of claim 8, wherein the first side engagement flap and the second side engagement flap are foldable relative to the left securing flap to adopt a coplanar relationship with the left securing flap.

10. The stackable and foldable box of claim 8, wherein the first side engagement flap and the second side engagement flap comprise a respective securing tab, wherein the securing tab of the first side engagement flap is inserted through a relatively smaller slot formed in the front panel to secure the first side engagement flap to the front panel, and wherein the securing tab of the second side engagement flap is inserted through a relatively smaller slot formed in the rear panel to secure the second side engagement flap to the rear panel.

11. The stackable and foldable box of claim 1, wherein the right securing flap is foldably connected to the right side panel.

12. The stackable and foldable box of claim 11, wherein the one or more right side projections comprise at least one projection formed along the right side panel upon folding the right securing flap out of a coplanar relationship with the right side panel.

13. The stackable and foldable box of claim 11, further comprising a first side engagement flap and a second side engagement flap foldably connected to a front edge and a rear edge of the right securing flap, wherein the first side engagement flap and second side engagement flap are arranged extending downward and over the front panel and rear panel, respectively, and are secured to the front panel and rear panel, respectively.

14. The stackable and foldable box of claim 13, wherein the first side engagement flap and the second side engagement flap are foldable relative to the right securing flap to adopt a coplanar relationship with the right securing flap.

15. The stackable and foldable box of claim 13, wherein the first side engagement flap and the second side engagement flap comprise a respective securing tab, wherein the securing tab of the first side engagement flap is inserted through a relatively smaller slot formed in the front panel to secure the first side engagement flap to the front panel, and wherein the securing tab of the second side engagement flap is inserted through a relatively smaller slot formed in the rear panel to secure the second side engagement flap to the rear panel.

16. The stackable and foldable box of claim 1, wherein the left securing flap and the right securing flap define a top opening therebetween, the top opening in communication with the interior space.

17. The stackable and foldable box of claim 16, wherein the top opening is arranged in continuation of the front opening.

18. The stackable and foldable box of claim 17, wherein the top opening extends to a top edge of the rear panel.

19. The stackable and foldable box of claim 1, further comprising a first left side flap foldably connected to a vertical left edge of the front panel, and a second left side flap foldably connected to a vertical left edge of the rear panel, the first and second left side flaps folded to form a right angle relative to the front panel and rear panel, respectively, and arranged against an inner side of the left side panel to support the left securing flap.

20. The stackable and foldable box of claim 19, wherein the one or more left side projections comprise a projection extending from the first left side flap and a projection extending upward from the second left side flap.

21. The stackable and foldable box of claim 19, wherein the first left side flap and second left side flap are foldable relative to the front panel and rear panel, respectively, to adopt a coplanar relationship with the front panel and rear panel, respectively.

22. The stackable and foldable box of claim 1, further comprising a first right side flap foldably connected to a vertical right edge of the front panel, and a second right side flap foldably connected to a vertical right edge of the rear panel, the first and second right side flaps folded to form a right angle relative to the front panel and rear panel, respectively, and arranged against an inner side of the right side panel to support the right securing flap.

23. The stackable and foldable box of claim 22, wherein the one or more right side projections comprise a projection extending from the first right side flap and a projection extending upward from the second right side flap.

24. The stackable and foldable box of claim 22, wherein the first right side flap and second right side flap are foldable relative to the front panel and rear panel, respectively, to adopt a coplanar relationship with the front panel and rear panel, respectively.

25. A stackable and foldable box comprising:

a bottom panel, a front panel, a rear panel, a left side panel, and a right side panel, wherein the bottom panel is generally horizontal, and the front panel, rear panel, left side panel and right side panel are foldably connected to a front edge, a rear edge, a left side edge, and a right side edge of the bottom panel, respectively, and are arranged in a generally vertical orientation, and further wherein the bottom panel, front panel, rear panel, left side panel and right side panel define an interior space of the box, and the front panel comprises a front opening in communication with the interior space;

a left securing flap foldably connected to the left side panel and arranged generally horizontally at a top left side of the box, the left securing flap connecting the front panel, the rear panel and the left side panel to one another and providing a first top horizontal surface;

a right securing flap foldably connected to the right side panel and arranged generally horizontally at a top right side of the box, the right securing flap connecting the front panel, the rear panel and the right side panel to one another and providing a second top horizontal surface coplanar to the first top horizontal surface;

one or more left side projections extending upward of a left end of the first top horizontal surface, and one or more cutouts formed in a vertically opposite, bottom left end of the box, wherein each left side projection of the one or more left side projections has a shape and size configured to fit inside a respective cutout of the one or more cutouts arranged vertically opposite to said each left side projection; and one or more right side projections extending upward of a right end of the second top horizontal surface, and one or more cutouts formed in a vertically opposite, bottom right end of the box, wherein each right side projection of the one or more right side projections has a shape and size configured to fit inside a respective cutout of the one or more cutouts arranged vertically opposite to said each right side projection.

26. A stackable and foldable box comprising:

a bottom panel, a front panel, a rear panel, a left side panel, and a right side panel, wherein the bottom panel is generally horizontal, and the front panel, rear panel, left side panel and right side panel are foldably connected to a front edge, a rear edge, a left side edge, and a right side edge of the bottom panel, respectively, and are arranged in a generally vertical orientation, and further wherein the bottom panel, front panel, rear panel, left side panel and right side panel define an interior space of the box, and the front panel comprises a front opening in communication with the interior space;

a left securing flap foldably connected to the left side panel and arranged generally horizontally at a top left side of the box, the left securing flap connecting the front panel, the rear panel and the left side panel to one another and providing a first top horizontal surface;

a right securing flap foldably connected to the right side panel and arranged generally horizontally at a top right side of the box, the right securing flap connecting the front panel, the rear panel and the right side panel to one another and providing a second top horizontal surface coplanar to the first top horizontal surface;

one or more left side projections extending upward of a left end of the first top horizontal surface, and one or more cutouts formed in a vertically opposite, bottom left end of the box, wherein each left side projection of the one or more left side projections has a shape and size configured to fit inside a respective cutout of the one or more cutouts arranged vertically opposite to said each left side projection;

one or more right side projections extending upward of a right end of the second top horizontal surface, and one or more cutouts formed in a vertically opposite, bottom right end of the box, wherein each right side projection of the one or more right side projections has a shape and size configured to fit inside a respective cutout of the one or more cutouts arranged vertically opposite to said each right side projection;

a first left side flap foldably connected to a vertical left edge of the front panel, and a second left side flap foldably connected to a vertical left edge of the rear panel, the first and second left side flaps folded to form a right angle relative to the front panel and rear panel, respectively, and arranged against an inner side of the left side panel to support the left securing flap; and a first right side flap foldably connected to a vertical right edge of the front panel, and a second right side flap foldably connected to a vertical right edge of the rear panel, the first and second right side flaps folded to form a right angle relative to the front panel and rear panel, respectively, and arranged against an inner side of the right side panel to support the right securing flap.

* * * * *